US005114123A

United States Patent [19]

Pfyl

[11] Patent Number: 5,114,123

[45] Date of Patent: May 19, 1992

[54] MANIPULATOR FOR MANIPULATING A POURING PIPE INTO POSITION BENEATH A METALLURGICAL VESSEL

[75] Inventor: Anton Pfyl, Affoltern, Switzerland

[73] Assignee: Didler-Werke AG, Wiesbaden, Fed. Rep. of Germany

[21] Appl. No.: 691,331

[22] Filed: Apr. 25, 1991

[30] Foreign Application Priority Data

Apr. 27, 1990 [CH] Switzerland ..... 1441/90

[51] Int. Cl.[5] ..... B22D 41/50

[52] U.S. Cl. ..... 266/236; 222/606; 222/607

[58] Field of Search ..... 222/591, 606, 607, 600; 266/236

[56] References Cited

U.S. PATENT DOCUMENTS 4,222,505 9/1980 Daussan et al. ..... 222/600
4,381,102 4/1983 King ..... 222/607

FOREIGN PATENT DOCUMENTS 2709727 9/1977 Fed. Rep. of Germany .

*Primary Examiner*—Scott Kastler
*Attorney, Agent, or Firm*—Wenderoth, Lind & Ponack

[57] ABSTRACT

A manipulator is disclosed for manipulating a pouring pipe from a remote position wherein it is oriented substantially horizontally, to a position beneath a metallurgical vessel wherein the pouring pipe is oriented substantially vertically. The manipulator includes a supporting frame which can be transferred on laterally extending track and longitudinally extending tracks from a remote location to a location adjacent the metallurgical vessel. The manipulator is adapted to detachably engage the pouring pipe such that the pouring pipe can be guided along a guide path which preferably includes curved portions. With this arrangement, the manipulator is operable to manipulate the pouring pipe in an accurate manner and without danger to operating personnel into position beneath the metallurgical vessel and into a continuous casting mold, even when space for such manipulation is narrow.

27 Claims, 3 Drawing Sheets

MANIPULATOR FOR MANIPULATING A POURING PIPE INTO POSITION BENEATH A METALLURGICAL VESSEL

BACKGROUND OF THE INVENTION

1. Field of the Invention

The invention relates generally to a manipulator for manipulating a pouring pipe into position beneath a metallurgical vessel, and more specifically to a manipulator for manipulating a pouring pipe from a remote substantially horizontal position into a vertical position beneath a metallurgical vessel.

2. Description of the Prior Art

In steel plants, the use of uninterrupted continuous casting processes has been increasing. To assure continuity of the casting processes, it is necessary that pouring pipes for use in pouring molten metal from a metallurgical vessel to a casting mold be replaced periodically. In order to replace a pouring pipe which is in position beneath a metallurgical vessel, it is necessary that a replacement pouring pipe be accurately guided from a remote position into the position beneath the nozzle of the metallurgical vessel.

A device for interchanging pouring pipes in the above manner is disclosed in DE-AS 27 09 727. In this device, guide tracks are mounted on the opposing sides beneath the nozzle of the metallurgical vessel, and a holder having guide pins on each side thereof is provided for holding the pouring pipe. The guide pins of the pouring pipe holder are adapted to slide along the guide tracks in such a manner that the pouring pipe is transferred from a remote location in which it is substantially horizontally positioned to a substantially vertical position as it is inserted into the casting mold and beneath the nozzle of the metallurgical vessel. However, use of this device requires that the pouring pipe be manually introduced into the guide track. Such manual introduction of the pouring pipe into the guide track can be difficult and considerably dangerous. That is, under normal conditions, there is only a very narrow space available for manipulation of the pouring pipe, and also the person required to manipulate the pouring pipe is subject to very high temperatures which are necessarily present in the continuous casting process. In addition, such person is also subject to the possibility of an unanticipated spillage or other outflow of molten metal from either the metallurgical vessel or the casting mold.

SUMMARY OF THE INVENTION

Accordingly, the object of the present invention is to provide a manipulator for manipulating a pouring pipe into position beneath a metallurgical vessel, wherein the manipulator is operator friendly in that it can be easily operated from a remote location and which is of a simple construction which can stand up to the heat and other harsh conditions encountered in a steel plant, and which is operable to accurately position the pouring pipe.

This object is attained by providing a manipulator having a supporting structure, a connecting means for detachably connecting the pouring pipe to the supporting structure, and a guiding means for moving the connecting means along a guide path from a rearward position toward a forwardly located position in which a metallurgical vessel is adapted to be positioned, while the pouring pipe, when connected to the supporting structure, is transferred from a substantially horizontal position to a substantially vertical position. The manipulator also preferably includes a transfer means for transferring the supporting structure from a remote location to a location adjacent the metallurgical vessel. The transfer means includes a carriage, a longitudinal transfer track mounted to the supporting structure, a plurality of longitudinal transfer rollers rotatably mounted to the carriage, a lateral transfer track adapted to be mounted in fixed relation relative to the metallurgical vessel, and a plurality of lateral transfer rollers rotatably mounted to the carriage for movement along the lateral transfer track.

By the inclusion of a transferring means for transferring the supporting structure into position adjacent the metallurgical vessel, the manipulator according to the present invention is operable to provide a very simple introduction of the pouring pipe into position beneath the nozzle of the metallurgical vessel. The construction of the manipulator according to the invention is particularly adapted to the harsh operating conditions encountered in a steel plant.

In addition, an interchanging means can be provided for interchanging the pouring pipe from a position in which it is connected adjacent a forward end of the guide path to a predetermined position beneath the nozzle of the metallurgical vessel. The interchanging means includes a supporting arm mounted relative to the metallurgical vessel and having a holding means, such as a groove formed in an end of the supporting arm adapted to receive a trunnion extending from the pouring pipe, in order to hold the pouring pipe.

In a particular preferred formed of the guiding means of the invention, the guiding means comprises an endless element such as an endless chain, trained about a pair of sprockets rotatably mounted to the supporting structure, as well as means for operatively connecting at least one of the sprockets to a rotary drive. The endless element and sprockets are arranged in such a manner that the connecting means, and thus the pouring pipe connected to the endless element by the connecting means, can be moved along the guide path with an orbital-type motion, wherein the pouring pipe is moved from a substantially horizontal position to a substantially vertical position in which it is connected beneath the nozzle of the metallurgical vessel. Preferably, the front sprocket, or sprocket located nearest the metallurgical vessel, is positioned downwardly relative to the rear sprocket such that the endless chain slopes downwardly and forwardly toward the metallurgical vessel.

The connecting means comprises a connecting element mounted to the guiding means for movement along the guide path, and an engaging element, such as a multi-sided bolt, slidably mounted in a rotatable bushing extending through the connecting element for lateral movement relative to the guide path between a first position in which it is adapted to engage with the pouring pipe and a second position in which it is adapted to release the pouring pipe.

A switching means is provided for slidably switching the engaging element between its first and second positions, and comprises an elongated rod rotatably mounted to the supporting structure adjacent to the guide path, a means for rotating the elongated rod, and a pushing/pulling means for pushing the engaging element toward the first position when the rod is rotated in a first direction and for pulling the engagement element toward the second position when the rod is rotated in a second direction. The pushing/pulling means comprises a pair of gripper plates fixed to and extending radially away from the elongated rod at front and rear ends thereof. The gripper plates are adapted to engage in an annular groove formed in the multi-sided bolt which is adapted to engage the pouring pipe. The rotating means comprises a linkage mounted eccentrically to the elongated rod, and a rotatable switch operatively connected to the linkage.

In an alternative form of the invention, the endless chain and sprockets can be replaced by a forwardly and rearwardly extending main guide track, and a means such as a piston/cylinder unit, for moving the connecting means longitudinally along the main guide track. The connecting means in this embodiment also comprises an engaging element, such as a multi-sided bolt, mounted for lateral movement relative to the main guide track between a first position in which it is adapted to engage with the pouring pipe and a second position in which it is adapted to release the pouring pipe. In addition, the connecting means includes a main sliding element which is slidably mounted in the main guide track and is mounted to the engaging element for movement therewith along the main guide track, and a connecting element mounted to the main sliding element and to the moving means. As with the endless chain of the first preferred form of the invention, the main guide track is sloped downwardly and forwardly toward the metallurgical vessel.

In order to ensure a uniform motion of the pouring pipe from its horizontal to its vertical position, the guiding means can further include an elongated auxiliary guide track mounted to the supporting structure and extending forwardly and rearwardly, and an auxiliary steering lever having a first end rotatably mounted to the connection means and a second end slidably mounted for movement along the auxiliary guide track. Preferably, the auxiliary guide track and the guide path along which the connecting means is adapted to move diverge from one another as they extend forwardly, and the auxiliary guide track is curved.

The pouring pipe can be further connected to the supporting structure by a forked member which is fixedly mounted to the auxiliary steering lever and rotatably mounted to the connecting element. The forked member has a forked portion adapted to receive a bolt extending from a bearing ring which supports the pouring pipe.

A bearing ring is normally engaged about the pouring pipe, and includes a pair of trunnions extending outwardly therefrom. These trunnions include a means, such as engaging holes formed therein, for engaging with the engaging element, such as the multi-sided bolt, of the connecting means. In both of the above-noted forms of the invention, a guide path or guide track identical to that noted above can be provided on the side of the device opposite the guide path or guide track noted above to provide stability in manipulating the pouring pipe. Of course, in this circumstance, other elements related to the guide track or guide path, such as a connecting means and an auxiliary steering lever can also be provided on opposing sides.

BRIEF DESCRIPTION OF THE DRAWINGS

Additional objects and advantages of the present invention will become more apparent upon reading the following detailed description with reference to the drawing figures, in which.

DETAILED DESCRIPTION OF THE INVENTION

Figure 1:
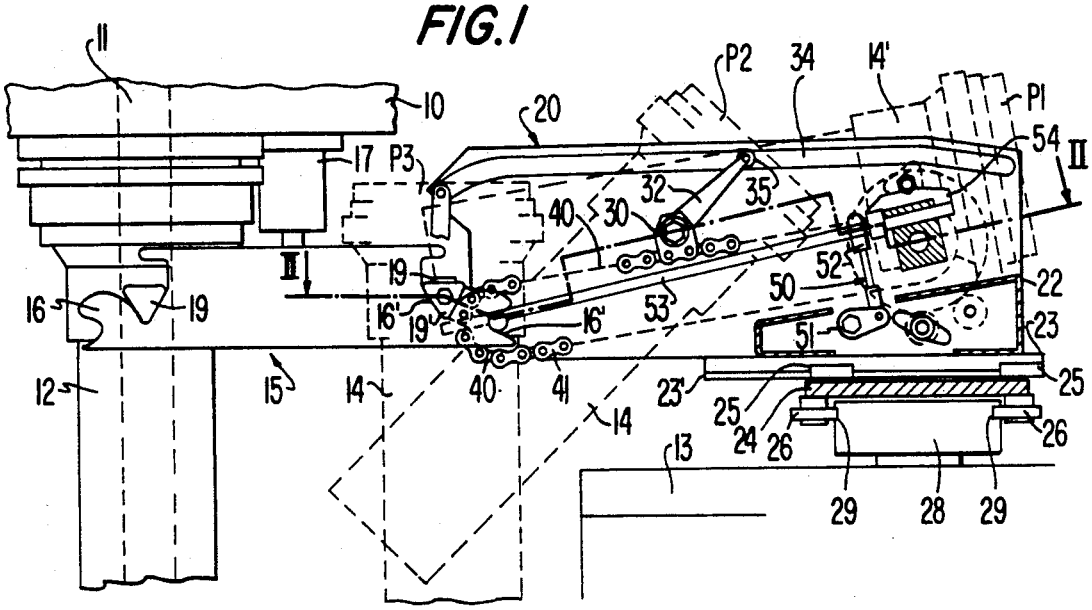
FIG. 1 is a longitudinal sectional view of a manipulator according to a first embodiment of the invention.

Referring to FIG. 1, a metallurgical vessel, adapted to contain molten metal therein, is shown having a nozzle 11. As is known, a slide valve or the like can be mounted against the nozzle 11 of the metallurgical vessel 11, or a pouring pipe 12, formed of refractory material, can be attached directly to the metallurgical vessel 10 beneath the nozzle 11. During pouring of molten metal from the metallurgical vessel 10 into a continuous casting mold 13, the pouring pipe 12 is held against the nozzle 11 of the metallurgical vessel 10 such that it projects into the casting mold 13. The pouring pipe 12 is held against the nozzle 11 by a supporting arm 16 of a pouring pipe interchanging device 15. This pouring pipe interchanging device defines part of an interchanging means which also preferably includes a piston/cylinder unit 17 for effecting vertical adjustment of the pouring pipe interchanging device 15 and thus of the pouring pipe 12. Although not shown in the drawing figures, the interchanging means can also include a device for pivoting the pouring pipe interchanging device 15 about a central vertical axis, and/or a device for moving the pouring pipe interchanging device 15 horizontally in, for example, the longitudinal direction (i.e. from left to right or vice versa in FIG. 1). According to the invention, each end of the supporting arm 16 of the pouring pipe interchanging device 15 has a forked portion defining a groove 16' adapted to receive a trunnion 19, 19' to support a pouring pipe 12 against the nozzle 11 of the metallurgical vessel 10, and/or a pouring pipe 14 in a standby position to be next utilized in position against the nozzle 11.

A manipulator 20 according to the present invention is provided for manipulating the pouring pipe 14 from a remote substantially horizontal position Pl, through an intermediate position P2 in which the pouring pipe 14 is beginning to be inserted into the casting mold 13, and to a substantially vertical position P3 in which the pouring pipe 14 is adapted to be suspended with its bottom end inserted into the casting mold 13 by the supporting arm 16 of the pouring pipe interchanging device 15. The manipulator 20 includes a supporting frame 22 which preferably has a longitudinal transfer track 23 forming a transfer path 23' mounted to a bottom surface thereof. Note that, although only one such longitudinal transfer track 23 is shown, it is preferred that two such tracks 23 be provided on opposing sides of the supporting frame 22. A carriage 24 is provided beneath the longitudinal transfer tracks 23 and includes a plurality (preferably at least two per track 23) of longitudinal transfer rollers 25 rotatably mounted thereto for movement in the longitudinal transfer tracks 23. Additionally, a lateral transfer track 28, preferably including a pair of lateral transfer paths 29, is fixed to the casting mold 13. A plurality (again, preferably two per lateral transfer path 29) of lateral transfer rollers 26 are rotatably mounted to the carriage 24 and are adapted to ride in the lateral transfer paths 29 of the lateral transfer track 28. With this arrangement, the manipulator 20, and thus the pouring pipe 14 connected thereto, can be transferred from a remote location into a position adjacent the metallurgical vessel such that the pouring pipe 14 can be moved into the position P3 in which it is suspended vertically by the supporting arm 16. The tracks 23 are arranged at right angles with respect to the two lateral transfer paths 29, and the paths 29 are machined into the lateral transfer track 28. The manipulator 20 can be moved along the transfer tracks into its position adjacent the metallurgical vessel 10 by any suitable means, such as by hand or by a suitable automatic drive mechanism. Alternatively, although not illustrated, the manipulator 20 can also be mounted or mountable on a truck, such as a self propelled wheeled truck.

Figure 2:
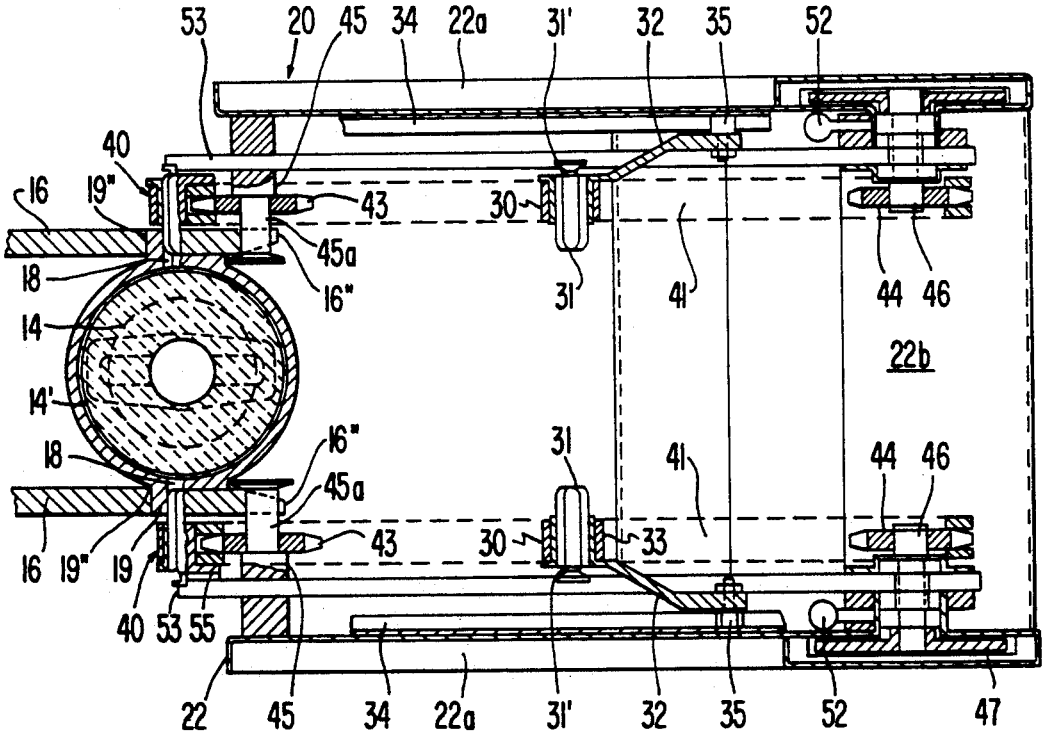
FIG. 2 is a cross sectional view taken along the line II—II in FIG. 1.

The manipulator 20 further includes on each side thereof, as shown in FIG. 2, a front sprocket 43, a rear sprocket 44, and an endless chain 41 trained about the front and rear sprockets. A pair of connecting elements 30 are mounted to the endless chains 41, respectively, and are provided with rotatable bushings 33 therein. Each of the rotatable bushings 33 slidably receives therein an engaging element or bolt 31 which is preferably multi-sided and which is adapted to detachably engage in a complementary multi-sided hole in a trunnion mounted on the pouring pipe 14 to support the pouring pipe 14. The sprockets 43, 44 are rotatably mounted to the supporting frame 22 by axles 45, 46, such that the front sprockets 43 are located downwardly and forwardly of the rear sprockets 44 and the endless chain 41 defines a downwardly and forwardly extending guide path 40′ which preferably slopes downwardly at about 15 degrees relative to the horizontal. In addition, a drive pinion is fixed to one of the rear axles 46 and, although not illustrated, is operatively connected to a suitable rotary drive mechanism. The drive pinion 47 can, of course, be alternatively fixed to any of the axles 45, 46, or more than one drive pinion can be fixed to respective ones of the axles 45, 46.

The supporting frame 22 includes a pair of substantially vertical side walls 22*a* and a cross member 22*b* which, as shown in FIG. 1, is preferably formed with a downward slope toward the forward end of the manipulator 20. With this arrangement, the sprockets 43, 44, the drive pinion 47, and the endless chain 41, which together define a guiding means, are operable to move a connecting means, defined by the engaging elements (or bolts) 31, the connecting elements 30, and the rotatable bushings 33 along the guide path 40′ from a rearward position toward a forwardly located position adjacent the metallurgical vessel. This arrangement is such that the pouring pipe 14, when connected to the supporting structure by the connecting means, can be transferred from a substantially horizontal position P1 to a substantially vertical position P3.

As stated previously, the multi-sided bolts 31 are slidable between inwardly located engaging positions in which they are adapted to engage in the multi-sided holes 18 of the trunnions 19, 19′ of the bearing ring 14′ which supports the pouring pipe 14, and outwardly located disengaging positions. To cause the sliding motion of the bolts 31, a switching means 50 is provided which includes a pair of elongated rods 53 rotatably mounted to the supporting frame 22, a rotatable switch 51 for rotating the rods 53, a linkage or hinge connection 52 for connecting the rotatable switch 51 to the rods 53, and a pushing/pulling means for pushing the bolts 31 toward their engaging positions when the rods 53 are rotated in a first direction and for pulling the bolts 31 toward their disengaging positions when the rods 53 are rotated in a second direction. The pushing-/pulling means includes front and rear gripper plates 54, 55 fixed to and extending radially from the rotating rods 53, respectively, and adapted to have their free ends engage in annular grooves 31′ formed respectively in outer ends of the bolts 31.

The manipulator 20 is arranged, when in its position adjacent the metallurgical vessel, such that the front sprockets 43 are adjacent to rearward ends of the supporting arms 16, and such that the pouring pipe 14 can be discharged from the manipulator to the pouring pipe interchanging device 15 by having the trunnions 19 inserted in the grooves 16′ formed in the forked ends of the supporting arms 16. The trunnions 19 are preferably shaped with a triangular cross section so as to form centering tips 19′ thereon. The grooves 16′ in the forked end portions of the supporting arms 16 are preferably formed with shapes complementary to the shapes of the trunnions 19, such that as the connecting elements 30, and thus the trunnions 19 of the pouring pipe 14, move along the guide path 40′ toward the supporting arms 16, and as the connecting elements 30 reach the front sprockets 43 and are carried through a rotary angle of approximately 60 to 90 degrees, the trunnions 19, and thus the pouring pipe 14, are discharged into the grooves 16′. The complementary shapes of the grooves 16′ and trunnions 19 are such as to compensate for any deviations of the positions of the grooves 16′ and the discharging positions of the trunnions 19. Accurate positioning of the manipulator 20, however, is normally ensured by the provision of recesses 16″ in the ends of the supporting arms 16. The recesses 16″ are adapted to receive centering portions 45*a* of the front axles 45 and thus accurately position the manipulator with respect to the supporting arms 16. In addition, the trunnions 19 of the bearing ring 14′ are provided with positioning faces 19″ which are provided at substantially right angles relative to a pivot axis of the trunnions 19, so as to center the pouring pipe between the supporting arms 16 with little or no play therebetween.

Referring again to FIGS. 1 and 2, the guiding means can further include a pair of elongated auxiliary guide tracks 34 mounted to the supporting frame 22 and extending forwardly and rearwardly, and a pair of auxiliary steering levers 32 having first ends mounted to the rotatable bushings 33 for rotation relative to the connecting elements 30 and second ends slidably mounted for movement along the auxiliary guide tracks 34, respectively. Although the second ends of the auxiliary steering levers 32 can be slidably mounted to the auxiliary guide tracks 34 by any suitable means, in the preferred embodiment of the present invention, rollers 35 are rotatably mounted thereto by any suitable means, such as nuts and bolts, and are adapted to ride in the auxiliary guide tracks 34 between forward and rearward ends thereof. To aid in pivoting and guiding the pouring pipe 14 from its substantially horizontal position P1 to its substantially vertical position P3, the auxiliary guide tracks 34 are curved such that they are arranged to diverge at an angle ranging from 5 to 30 degrees (which averages about 20 degrees) from the direction of the guide path 40' (see FIG. 1), as shown in FIG. 1. The curvature of the auxiliary guide tracks 34 includes forwardly located curved portions 34*a* which correspond approximately to the forward portion of the guide path 40' defined by forward portions of the endless chains 41 as they turn about the front sprockets 43. This arrangement provides for a uniform movement of the pouring pipe 14 from its substantially horizontal position P1 to its substantially vertical position P3.

In operation of the manipulator 20, the connecting elements 30 are moved into their upper positions P1 and the bolts 31 are moved into their disengaging positions by actuating the rotary switch 51 so as to rotate rods 53 which, in turn, rotate the rear gripper plates 54 engaged in the annular grooves 31' of the bolts 31. The pouring pipe 14 is then inserted into the supporting frame 22 into position Pl, and the rotary switch 51 is again actuated to rotate the rods 53 in a reverse direction and cause the rear gripper plates 54 to push the bolts 31 toward their engaging positions, in which they are inserted into the multi-sided holes 18 formed in trunnions 19 of bearing rings 14' which holds the pouring pipe 14. At this stage, the supporting frame 22 can be transferred into the position, shown in FIG. 1, adjacent the metallurgical vessel 10 by the transfer means defined by tracks 23, 28, carriage 24, and rollers 25, 26. The centering portions 45*a* of the axles 45 are locked in the recesses 16'' formed in the supporting arms 16. The pouring pipe 14 can then be moved from its substantially horizontal position P1 through its intermediate position P2 and into its substantially vertical position P3 either manually or by a suitable drive means, such as endless chain 41 trained about sprockets 43, 44 and driven by a drive mechanism.

After the pouring pipe 14 is moved to position P3 in which the trunnions 19 of the bearing ring 14' holding the pouring pipe 14 are engaged in the grooves 16' of the supporting arms 16 of the pouring pipe interchanging device 15, the rotary switch 51 can again be actuated so as to rotate the rods 53 and the front gripper plates 55, and thereby pull the bolts 31 into their disengaging positions. The manipulator 20 can then be transferred away from its position adjacent the metallurgical vessel 10, and the supporting arms 16 can be rotated or otherwise moved such that the pouring pipe 14 is moved into position beneath the nozzle 11 of the metallurgical vessel 10 to replace the pouring pipe 12. Such replacement of the pouring pipe 12 is necessary after a period of use, as the refractory material of the pouring pipe 12 becomes abraded and otherwise degraded by the molten metal being poured from the metallurgical vessel 10 and into the casting mold 13. This process of manipulating a pouring pipe can then be repeated as necessary.

Figure 3:
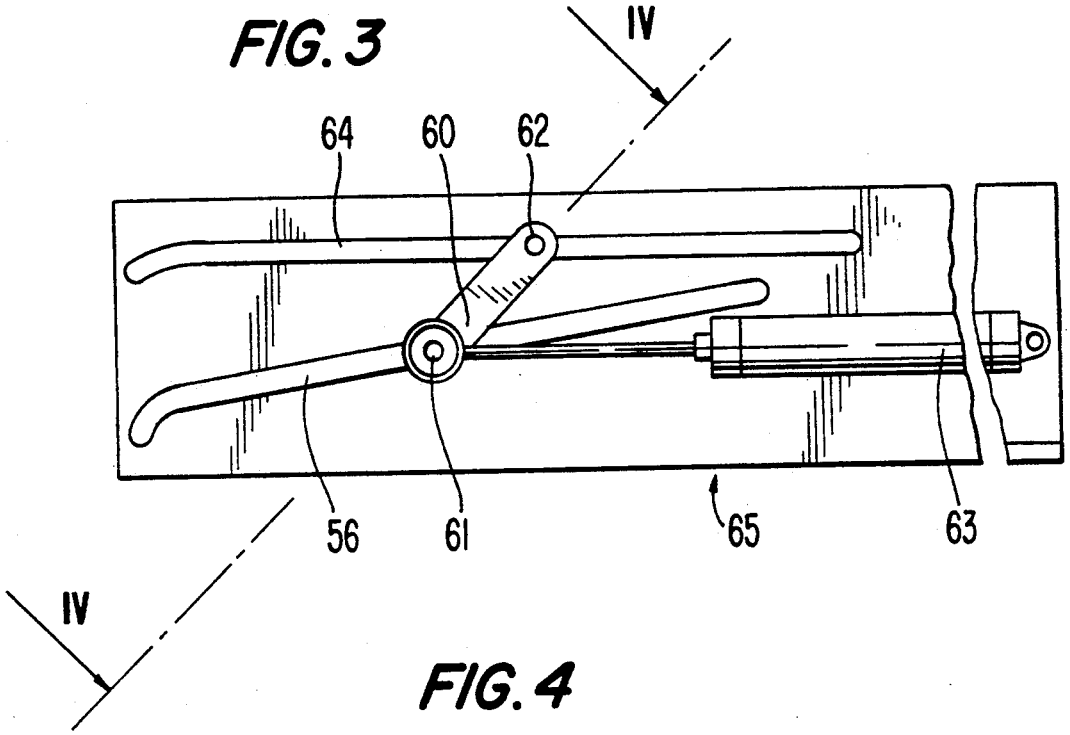
FIG. 3 shows a portion of a manipulator in accordance with a second embodiment of the invention.
Figure 4:
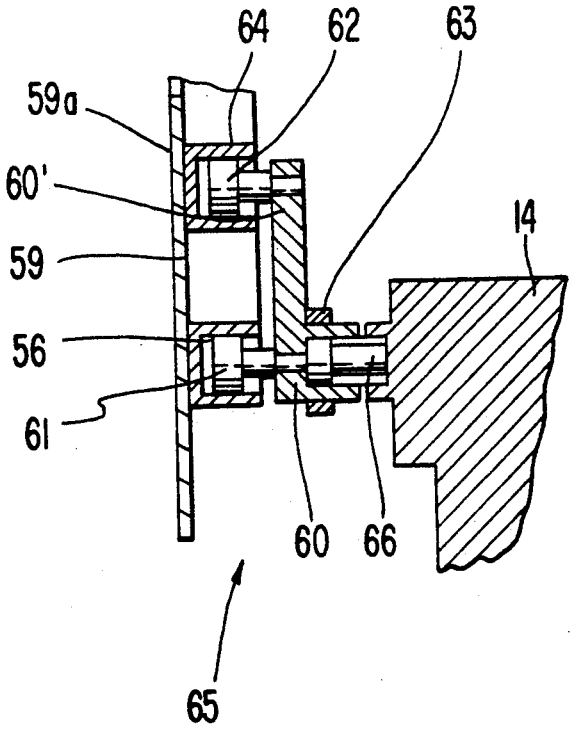
FIG. 4 is a cross sectional view of the portion of the manipulator shown in FIG. 3, taken along line IV—IV in FIG. 3.

A portion of a second embodiment of a manipulator 65 according to the invention is shown in FIGS. 3 and 4. The manipulator 65 of this embodiment includes a guiding means which, rather than comprising a chain drive and sprockets as in the first embodiment, comprises a main guide track 56 and a piston/cylinder unit 63 for moving a connecting means longitudinally along the main guide track 56. Although only one main guide track and one piston/cylinder unit are shown in FIGS. 3 and 4, it is contemplated that a pair of main guide tracks and piston/cylinder units can be provided, one on each side of a guide path for the pouring pipe 14. The main guide tracks 56, like the endless chains 41 of the first embodiment are sloped downwardly and forwardly at preferably about 15 degrees relative to the horizontal.

The connecting means of this embodiment comprises a pair of engaging elements, such as multi-sided bolts 66, adapted to releaseably engage in multi-sided holes formed in trunnions attached to the pouring pipe 14, a pair of connecting elements 60 to which the multi-sided bolts are mounted and to which the piston/cylinder units 63 are operatively connected, and a pair of main sliding elements 61 connected to the connecting elements 60 and slidably mounted for movement along the main guide tracks 56, respectively. As in the first embodiment, the bolts 66 of this second embodiment are laterally slidable into and out of engagement with the pouring pipes 14.

Auxiliary steering levers 60' can also be utilized in this embodiment. The auxiliary steering levers 60' are connected at their lower ends to the connecting elements 60 and at their upper ends are slidably mounted for movement along a pair of auxiliary guide tracks 64 which, like the main guide tracks 56, are formed in or mounted to the supporting frame 59. The upper ends of the auxiliary steering levers have sliding elements 62 respectively mounted thereto for slidably mounting the auxiliary steering levers 60' for movement along the auxiliary guide tracks 64. The supporting frame 59, like supporting frame 22 of the first embodiment, comprises one or two side walls 59*a* and a cross member (not shown). As shown in FIGS. 3 and 4, the multi-sided bolts 66 are arranged coaxially with the main sliding elements 61.

In other respects not specifically mentioned, the manipulator 65 according to the second embodiment is of basically identical design to that of the manipulator 20 of the first embodiment shown in FIGS. 1 and 2.

Figure 5:
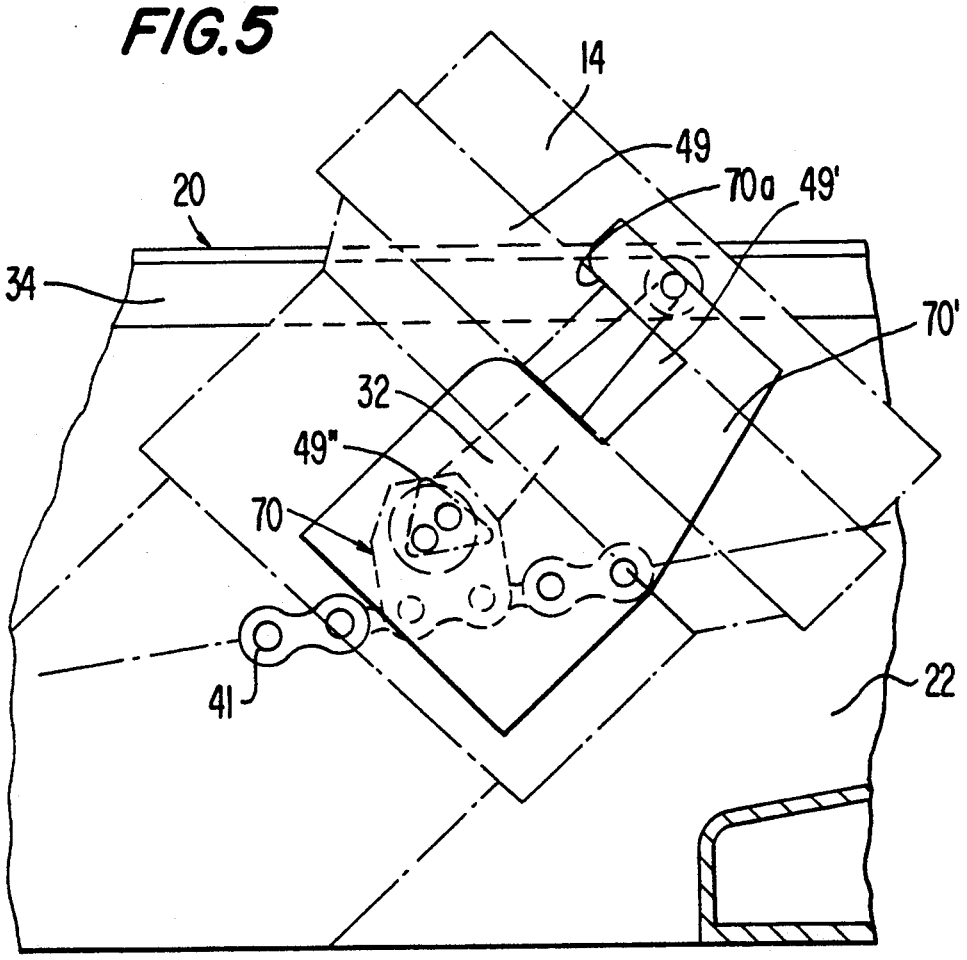
FIG. 5 shows a portion of a manipulator according to a third embodiment of the invention.

FIG. 5 shows a portion of a manipulator 20 according to a third embodiment of the invention, in which the structure of the manipulator is substantially identical to that of the manipulator according to the first embodiment, except with respect to the structure of a connecting means. In this third embodiment, the connecting means includes a pair of connecting elements 70 which are mounted to the chains 41, and a pair of fork members 70' which are preferably formed of sheet metal. The fork members 70' are rotatably mounted to the connecting elements 70, are fixed to the auxiliary steering levers 32, and are disposed inside of the endless chains 41 such that, when the pouring pipe 14 is engaged by the connecting means, the fork members 70' are disposed between the endless chains 41 and the pouring pipe 14, respectively. In this embodiment, a metal bearing ring 49 is provided to engage about the pouring pipe 14 and includes a pair of rectangular supporting bolts 49' extending radially outwardly therefrom on each side of the bearing ring 49. The fork members 70' are formed with recesses 70*a* therein which are preferably shaped to be complementary with the rectangular supporting bolts 49', and are adapted to receive such supporting bolts 49'. The recesses 70*a* are arranged in such a manner that when the rectangular supporting bolts 49' are received therein and the pouring pipe 14 is disposed in position P1 (see FIG. 1), the entrance portions of the recesses 70*a* are facing vertically upwardly. As in the first embodiment, trunnions 49'' are provided on each side of a bearing ring supporting the pouring pipe 14 and are adapted to receive engaging elements such as multi-sided bolts, as described in detail above in connection with the first embodiment shown in FIGS. 1 and 2. With the arrangement of this third embodiment, the fork members 70′ provide additional support for the pouring pipe 14 as it is guided through its path, wherein the pouring pipe is moved from its substantially horizontal position P1 to its substantially vertical position P3. The orientations of the recesses 70*a* are such that the fork members 70′ will secure the upper portion of the pouring pipe 14 during movement thereof along its path, but will allow discharge of the pouring pipe 14 when it reaches its substantially vertically position P3.

Although in general, it is preferable that the manipulator of the invention be provided with a supporting structure having opposing side walls, as well as guide tracks, guiding means and connecting means on both sides, it is contemplated that, in certain circumstances, the manipulator can be provided with a supporting structure having only one side wall, and with guide tracks, connecting means and guiding means on only one side. For example, a pouring pipe may need be supported on only one side thereof if the pouring pipe is sufficiently small. If, however, the pouring pipe to be utilized is relatively heavy or large, or if it is to be utilized in a process for continuously casting slabs, it is best to support the pouring pipe on both sides thereof.

In addition, although the inclusion of the auxiliary steering levers 32 or 60′ is preferable, it can be eliminated when the manipulator 20 is to be used for manipulating relatively small pouring pipes or when it is necessary to adapt the manipulator to fit in small spaces. When the manipulator does not include the auxiliary steering levers 32, 60′, however, it is necessary that the pouring pipe 14 be attached at position P1 to the chains 41 or the main guide track 56 by the connecting means with the longitudinal axis of the pouring pipe 14 substantially parallel to the guide path.

Although preferred embodiments of the present invention have been set forth in the above description, many modifications will be apparent to those of ordinary skill in the art, and should be construe as being within the scope of the invention, as defined in the appended claims.

What is claimed:

1. An apparatus for manipulating a pouring pipe into and out of a predetermined position beneath a metallurgical vessel, comprising:

a supporting structure;

connecting means for detachably connecting the pouring pipe to said supporting structure;

guiding means for forcing said connecting means to move along a guide path from a rearward position toward a forwardly located position adjacent which the metallurgical vessel is adapted to be positioned, while the pouring pipe, when connected to said supporting structure, is transferred from a substantially horizontal position to a substantially vertical position;

wherein said guiding means comprises an endless element mounted to said supporting structure for rotation relative thereto, said endless element extending along said guide path; and wherein said connecting means is mounted to said endless element.

2. An apparatus as recited in claim 1, wherein said guiding means further comprises a front sprocket rotatably mounted to said supporting structure, a rear sprocket rotatably mounted to said supporting structure rearwardly of said front sprocket, and means for connecting at least one of said front and rear sprockets to a drive; and said endless element comprises an endless chain trained about said front and rear sprockets.

3. An apparatus as recited in claim 2, wherein said front sprocket is located downwardly relative to said rear sprocket that said endless chain slopes downwardly and forwardly.

4. An apparatus as recited in claim 1, wherein said guiding means further comprises an elongated auxiliary guide track mounted to said supporting structure and extending forwardly and rearwardly, and an auxiliary steering lever having a first end mounted to said connecting means and a second end slidably mounted for movement along said auxiliary guide track.

5. An apparatus as recited in claim 4, wherein said auxiliary guide track and said guide path diverge from one another as they extend forwardly.

6. An apparatus as recited in claim 5, wherein said auxiliary guide track is curved such that an angle of divergence between said guide path and said auxiliary guide track varies from 5 degrees to 30 degrees.

7. An apparatus as recited in claim 1, wherein said connecting means comprises a connecting element mounted for movement relative to said supporting structure, and an engagement element slidably mounted to said connecting element for movement between a first position in which it is adapted to engage with the pouring pipe and a second position in which it is adapted to release the pouring pipe.

8. An apparatus as recited in claim 7, further comprising switch means for slidably switching said engaging element between said first and second positions.

9. An apparatus as recited in claim 8, wherein said switching means comprises an elongated rod rotatably mounted to said supporting structure adjacent said guide path, means for rotating said elongated rod, and pushing/pulling means for pushing said engaging element toward said first position when said rod is rotated in a first direction and for pulling said engaging element toward said second position when said rod is rotated in a second direction.

10. An apparatus as recited in claim 9, wherein a trunnion member is adapted to be mounted to the pouring pipe and has a multi-sided hole therein; and said engaging element comprises a multi-sided bolt which is shaped complementary to said multi-sided hole, has an annular groove formed thereabout, and slidably extends into said multi-sided hole.

11. An apparatus as recited in claim 10, wherein said pushing/pulling means comprises at least one gripper plate fixed to and extending radially away from said elongated rod and adapted to engage in said annular groove formed in said bolt.

12. An apparatus as recited in claim 11, wherein said at least one gripper comprises a front gripper plate mounted to said rod adjacent said front sprocket and a rear gripper plate mounted to said rod adjacent said rear sprocket.

13. An apparatus as recited in claim 9, wherein said rotating means comprises a linkage mounted eccentrically to said elongated rod, and a rotatable switch operatively connected to said linkage.

14. An apparatus for manipulating a pouring pipe into and out of a predetermined position beneath a metallurgical vessel, comprising:

a supporting structure;

connecting means for detachably connecting the pouring pipe to said supporting structure;

guiding means for forcing said connecting means to move along a guide path from a rearward position toward a forwardly located position adjacent which the metallurgical vessel is adapted to be positioned, while the pouring pipe, when connected to said supporting structure, is transferred from a substantially horizontal position to a substantially vertical position;

wherein said guiding means comprises a forwardly and rearwardly extending main guide track, and a moving means for forcing said connecting means to move longitudinally along said main guide track;

wherein said moving means comprises a piston/cylinder unit operatively connected to said connecting means; and wherein said main guide track is sloped downwardly and forwardly.

15. An apparatus as recited in claim 14, wherein said guiding means further comprises an elongated auxiliary guide track mounted to said supporting structure and extending forwardly and rearwardly, and an auxiliary steering lever having a first end mounted to said connecting means and a second end slidably mounted for movement along said auxiliary guide track.

16. An apparatus as recited in claim 15, wherein said auxiliary guide track and said main guide track diverge from one another as they extend forwardly.

17. An apparatus as recited in claim 16, wherein said auxiliary guide track is curved such that an angle of divergence between said main guide track and said auxiliary guide track varies from 5 degrees to 30 degrees.

18. An apparatus as recited in claim 14, wherein said connecting means comprises an engaging element operatively mounted to said main guide track for lateral movement relative thereto between a first position in which said engaging element is adapted to engage with the pouring pipe and a second position in which said engaging element is adapted to release the pouring pipe.

19. An apparatus as recited in claim 18, wherein said connecting means further comprises a main sliding element laterally slidably mounted in said main guide track and mounted to said engaging element for movement therewith along said main guide track, and a connecting element mounted to said main sliding element and to said moving means.

20. An apparatus as recited in claim 1, wherein said connecting means comprises a connecting element, and a forked member pivotably mounted to said connecting element and having a forked end adapted to engage with the pouring pipe.

21. An apparatus as recited in claim 20, wherein said connecting means further comprises a bearing ring adapted to be fixed about the pouring pipe, and a supporting bolt protruding outwardly from said bearing ring, said supporting bolt being engageable in said forked end of said forked member.

22. An apparatus as recited in claim 1, further comprising transfer means for transferring said supporting structure from a remote location to a location adjacent the metallurgical vessel.

23. An apparatus as recited in claim 22, wherein said transfer means is operable for transferring said supporting structure laterally with respect to a longitudinal direction of said guide path and longitudinally with respect to the longitudinal direction of said guide path.

24. An apparatus as recited in claim 23, wherein said transfer means comprises a carriage, a longitudinal transfer track mounted to one of said carriage and said supporting structure, a plurality of longitudinal transfer rollers rotatably mounted to the other of said carriage and said supporting structure, a lateral transfer track, and a plurality of lateral transfer rollers, one of said lateral transfer track and said plurality of lateral transfer rollers being mounted to said carriage and the other of said lateral transfer tracks and said plurality of lateral transfer rollers being adapted to be mounted in fixed relation relative to the metallurgical vessel.

25. An apparatus as recited in claim 23, further comprising means for interchanging the pouring pipe from a position in which it is connected adjacent a forward end of the guide path to the predetermined position beneath the metallurgical vessel.

26. An apparatus as recited in claim 25, wherein said interchanging means comprises a supporting arm mounted relative to the metallurgical vessel and having a holding means thereon for holding the pouring pipe.

27. An apparatus as recited in claim 26, wherein said holding means comprises a groove formed in an end of said supporting arm, said groove being adapted to receive a trunnion extending from the pouring pipe.

* * * * *